US005826761A

United States Patent [19]

Basaj

[11] Patent Number: 5,826,761

[45] Date of Patent: Oct. 27, 1998

[54] ANTI-EMBOLISM STOCKING AID

[75] Inventor: Barbara L. Basaj, Milwaukee, Wis.

[73] Assignee: Smith & Nephew, Inc., Memphis, Tenn.

[21] Appl. No.: 767,548

[22] Filed: Dec. 16, 1996

[51] Int. Cl.[6] ..... A47G 25/90

[52] U.S. Cl. ..... 223/112; 223/111

[58] Field of Search ..... 223/111, 112, 223/118, 119

[56] References Cited

U.S. PATENT DOCUMENTS

| | | | |
|---|---|---|---|
| 3,310,209 | 3/1967 | Clauss | 223/111 |
| 3,401,856 | 9/1968 | Berlin | 223/111 |
| 3,853,252 | 12/1974 | Scianimanico | 223/111 |
| 4,637,332 | 1/1987 | Doorenboos | 223/111 |
| 4,898,309 | 2/1990 | Fischer | 223/111 |

FOREIGN PATENT DOCUMENTS

| | | | |
|---|---|---|---|
| 2221604 | 2/1990 | United Kingdom | 223/111 |

*Primary Examiner*—Bibhu Mohanty
*Attorney, Agent, or Firm*—Pravel, Hewitt & Kimball

[57] ABSTRACT

A compression garment aid upon which a compressive garment, such as a therapeutic elastic stocking, is disposed in order that the foot of the wearer may be interposed into the aid to begin application of the stocking to the foot and leg of the wearer. As the toe of the foot is inserted into the toe of the stocking, the wearer grasps handles connected to the heel portion of the aid to gradually draw the aid rearwardly over the foot, including the instep, and upwardly over the calf of the wearer's leg. The aid is of a U-shaped channel configuration having a depth in the toe and heel portions whereby the compression garment is extended (stretched) over the form of the aid that it does not bear substantially on the foot and leg during donning so as to impede putting on of the stocking. Additionally, the upwardly extending sides of the channel are fitted with a smoothed serrated edge which causes the compressive stocking to be played out onto the leg as the aid is drawn upwardly on the leg as to cause the stocking to be uniformly and effectively disposed in position for the therapeutic benefit.

16 Claims, 4 Drawing Sheets

FIGURE 7
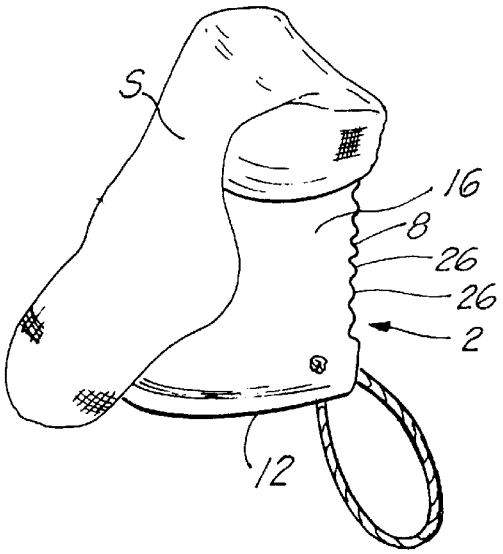
FIGURE 8
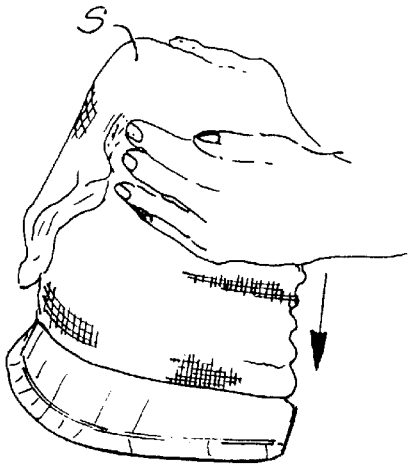
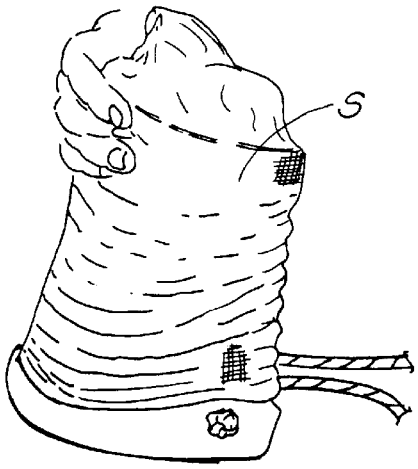
FIGURE 9
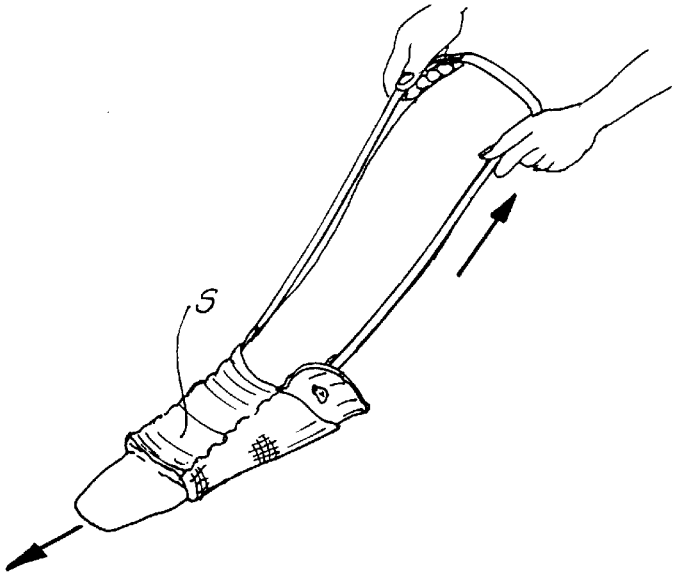
FIGURE 10

ANTI-EMBOLISM STOCKING AID

CROSS REFERENCE TO RELATED APPLICATIONS

None

BACKGROUND OF THE INVENTION

The present invention relates to a device for putting on therapeutic elastic stockings. The device is effective whether the elastic stockings are open at the top or additionally open at the toe. Whether the stocking is of the full-leg variety, i.e. extends up over the thigh portion of the leg, or is of the calf or mid-thigh variety, the device is effective in facilitating the application of the sock/stocking.

Therapeutic elastic stockings are conventionally worn by sufferers of varicose veins or crural ulcers, or in the case of injuries such as contusions or sprains. Those individuals with circulatory disorders may be required to wear particularly tight-fitting hosiery or stockings to provide a compression force on the outer surface of the legs (particularly the lower portion) and the feet to reduce excess edema. The strongly elastic nature of these stockings which provides the compressive force necessary for the therapeutic benefit of the stockings renders the stockings difficult to don. Application of such stockings is often further complicated by a wearer's lack of strength or flexibility resulting from general physical condition (including effects of aging, arthritic ailments, sciatica, lumbago, and congestive heart failure) or a recent injury or surgery (such as foot, knee or hip arthroplasty, and surgeries involving the back, cardiovascular or pulmonary systems) causing the need for the use of the elastic stockings.

The plethora of prior art illustrates the variety of devices developed to address this difficult task of applying elastic stockings. One of the more simple devices for applying elastic stockings is illustrated in U.S. Pat. No. 4,497,242 to Smith incorporating a ring device having collector legs disposed around the periphery for gathering the stocking. The device is designed primarily for use by a health care worker rather than the wearer. U.S. Pat. Nos. 4,896,803 to Wilkens and 4,942,988 to Doorenbos illustrate an alternative type of device, being adapted to have the stocking disposed over a wire frame, somewhat similar to '242 to Smith however including means for the frame to be freestanding, into which the foot is inserted to initiate the application process. Neither of these frames are adapted with means to facilitate application of the stocking to a fully donned condition.

U.S. Pat. No. 4,858,795 to Selinko illustrates a shoe-horn type device for assistance in the putting on of stockings. The device is however, not adapted to meet the requirements of elastic stockings and their compressive loads. U.S. Pat. No. 5,356,057 to Vossen illustrates a device for applying therapeutic elastic stockings. The device is similar to a slipper including an inner, slippery sleeve. The slipper is placed on the foot and the stocking pulled onto the foot over the slipper. While this design provides a smooth gliding surface over which the stocking may be pulled, it does not provide the wearer of the stocking any assistance above the foot to enhance the pulling of the stocking over the instep and calf of the leg or higher. Additionally, the device is useful only for therapeutic stockings which are toe-free.

Alternative approaches to expanding an elastic stocking as an assist in application are illustrated in U.S. Pat. Nos. 4,789,087 to Doorenbos and 5,513,783 to White. These devices include hinge mechanisms which expand a frame over which the stocking is placed. Once the stocking is in place on the form, handles are actuated to expand the frame and the stocking to facilitate the entry of the foot into the stocking. Unfortunately, these devices also do not provide any assistance to the wearer in the advancing of the stocking over the instep, calf or higher on the leg.

Devices somewhat similar to the shoe-horn device of '795 to Selinko are sold by several medical device companies (including the assignee of the present invention) as part of their rehabilitative lines. These devices are commonly referred to as "sock aids", "stocking aids", sock/stocking "starters" or some equivalent identifier. A usual form of this type device is similar to the U-shaped end portion of the Selinko device however having straps or chords extending from the device in lieu of the elongated handle of Smith. Most of the sock aids are pre-formed of a flexible material to a U-shaped channel similar to Smith, however some sock aids are planar in construction and rely upon the compressive forces of the stocking to form a channel shape with the stocking disposed there-around. In addition to Smith & Nephew Rolyan Inc., these prior devices have been available from such suppliers as AliMed, North Coast Medical and Sammons Preston.

As with most of the patented devices, the rehabilitative devices referred to are useful in starting the process of applying a stocking but are not adapted to carry the process over the instep, calf and upwards on the leg. This shortcoming is particularly critical when the stocking to be donned is a therapeutic elastic stocking such as the tight fitting type to apply constrictive forces to the leg to preclude pooling of fluids. In addition to the strongly elastic nature of these stockings, many people find it difficult to exert the force to pull up the stockings. Unfortunately, it is frequently the case that the persons requiring these highly elastic stockings are also those who lack or are constrained from exerting the necessary flexibility and strength to bend the legs and/or torso to manipulate and pull up these constraining sleeves. Whether the cause is a physical limitation of an individual or a restriction imposed by a health care professional, the ability of an individual to function independently is dependent upon that individual's ability to don these necessary, usually prescribed, compressive stockings. In absence of a suitable aid to the donning of these compressive garments, the individual is forced to rely upon another in a household for assistance. Should the afflicted individual live alone, discharge from hospital or continued subsistence at home may be dependent upon the availability of such an aid. With the early discharge practice currently exercised by hospitals, this inability to personally don required therapeutic elastic stockings may force an individual into a nursing home when they might otherwise be able to continue their independent life style.

SUMMARY OF THE INVENTION

It is, accordingly, an object of the present invention to provide a simple device which facilitates the putting on of compression stockings, independently by the wearer, such that the stockings are applied in a uniform manner over the leg and with a modicum of strength and manipulation.

An alternative objective of the invention is to provide a sock or stocking application device which will assist the wearer of the stocking in the application of the stocking continuously over the foot, past the instep to the calf of the leg.

A further objective of the present invention is a stocking application device which can support a therapeutic elastic stocking without collapsing when the stocking is totally disposed thereon and additionally shields the wearers foot and leg from the compressive effects of the stocking during the application process until the stocking is substantially disposed over the calf portion of the leg.

A still further objective of the present invention is to provide a compressive stocking application device which will readily accommodate an edematous foot or leg in the donning of a compressive stocking to control such edema.

These and other objects and features of the invention will become evident from the drawings and the following Detailed Description of a Preferred Embodiment.

BRIEF DESCRIPTION OF THE DRAWING

FIG. 7 is a pictorial view of a compression garment being applied to the inventive garment aid.

FIG. 8 is a pictorial view further illustrating applying the compression garment on to the garment aid of the invention.

FIG. 9 is a pictorial view illustrating the compression garment fully disposed on the garment aid of the invention.

FIG. 10 is a pictorial view illustrating utilization of the garment aid in applying the compressive garment to the foot and leg of a wearer, according to my invention.

DETAILED DESCRIPTION OF THE INVENTION

Figure 1:
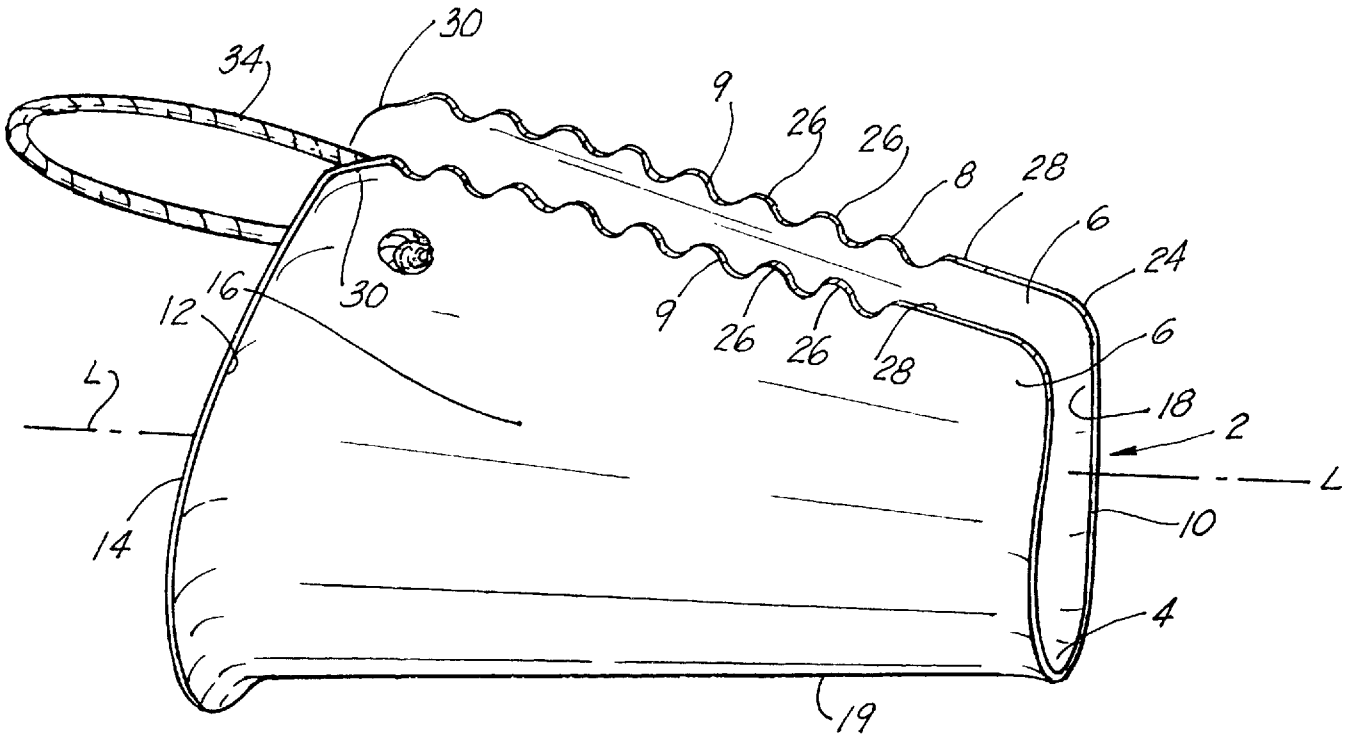
FIG. 1 is a side perspective view of a Compression Garment Aid embodying my invention.
Figure 3:
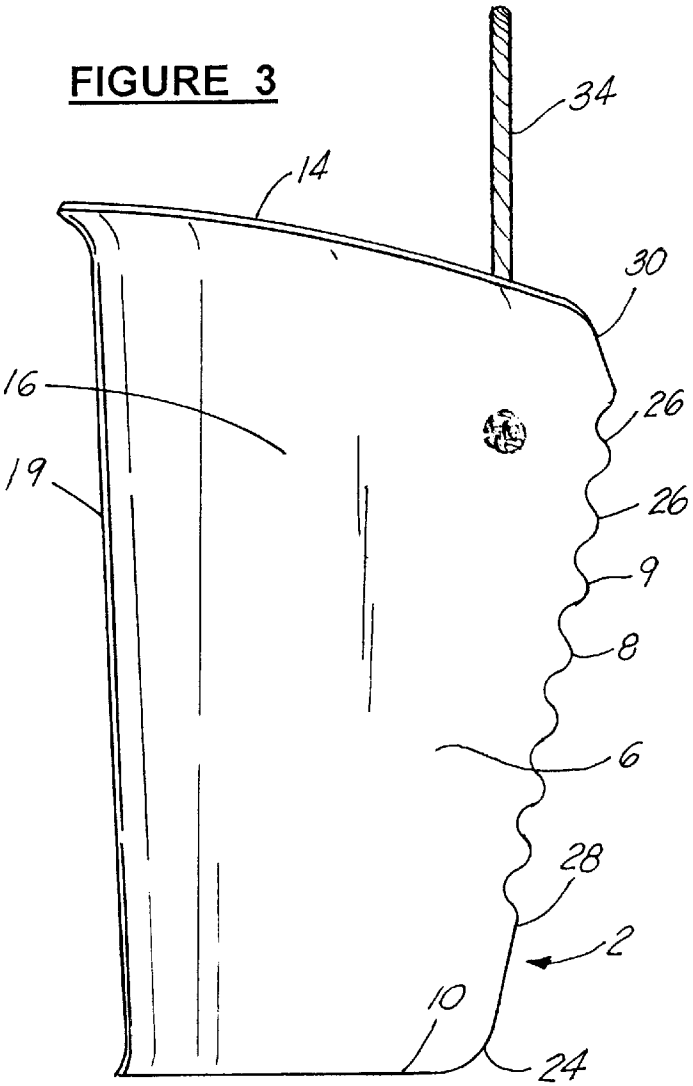
FIG. 3 is a right side elevational view of the embodiment of FIG. 1.
Figure 2:
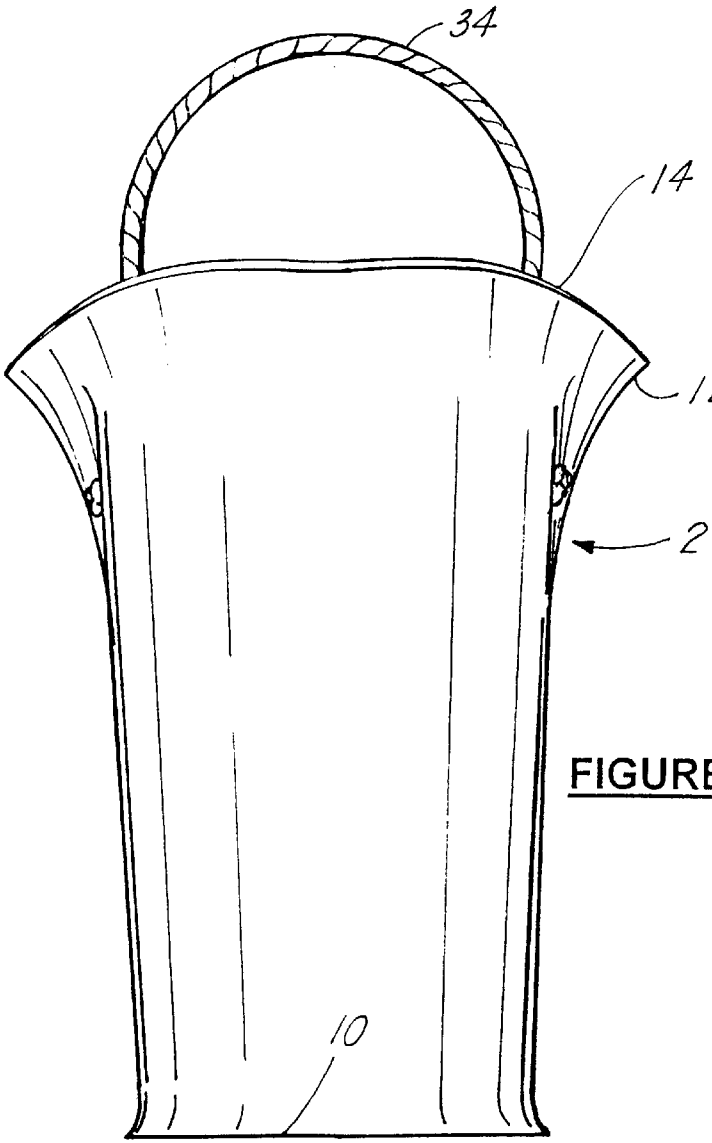
FIG. 2 is a bottom plan view of the embodiment of FIG. 1.
Figure 5:
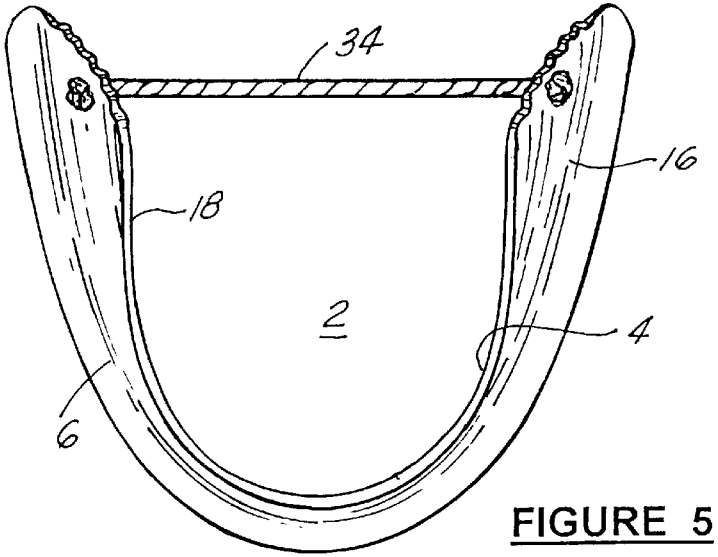
FIG. 5 is a front elevational view thereof.
Figure 6:
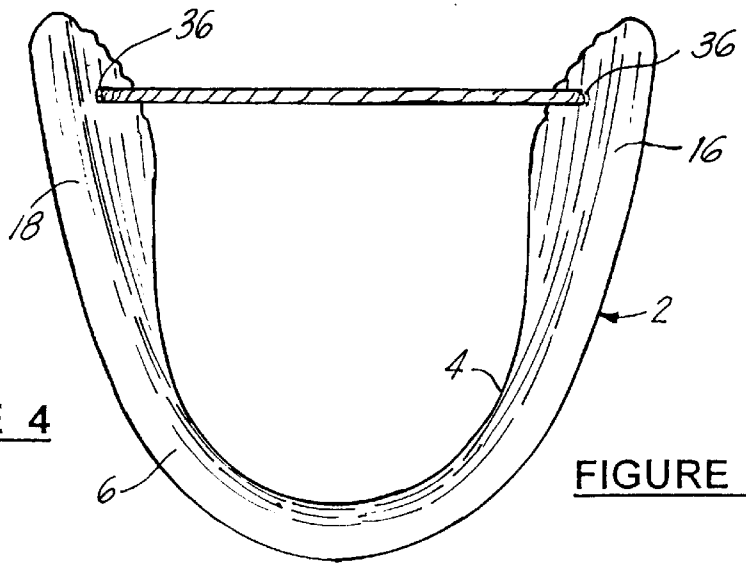
FIG. 6 is a rear elevational view thereof.
Figure 4:
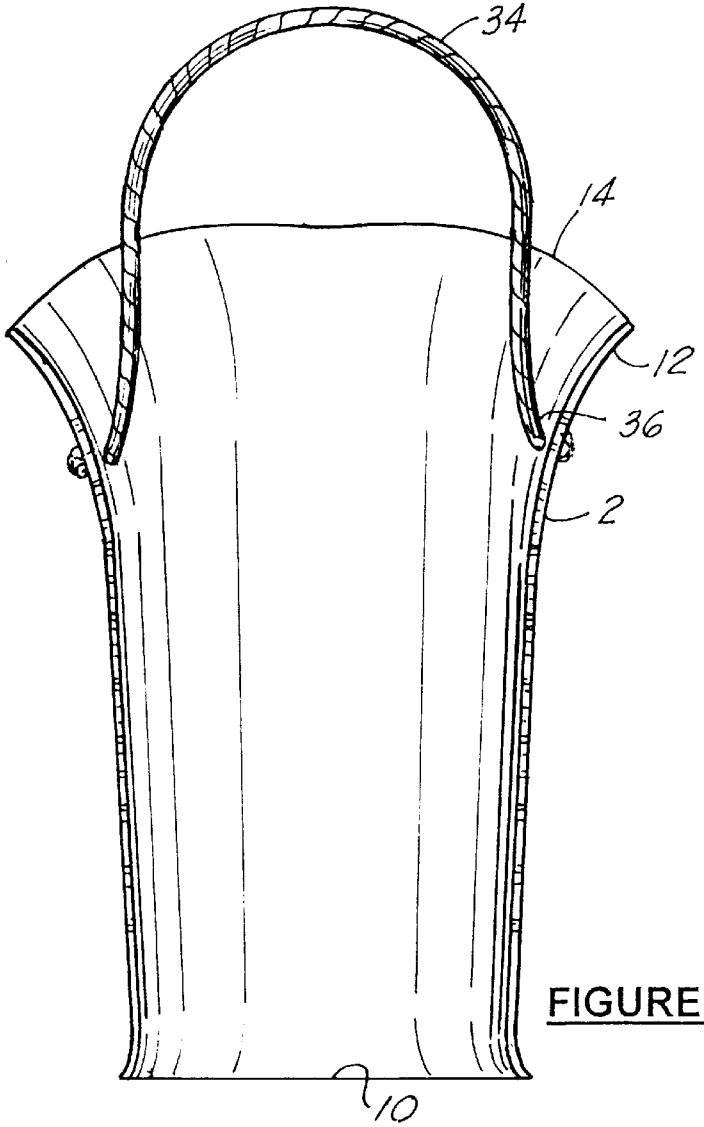
FIG. 4 is a top plan view thereof.

Referring now to the Figures, and in particular to FIG. 1 through FIG. 6, reference number 2 indicates the compression garment aid embodying the present invention. Garment aid 2 is a generally U-shaped channel 4 having substantially parallel upstanding side walls 6 terminating in longitudinal side wall edges 8 having a serrated portion 9. The side walls 6 of garment aid 2 terminate at a toe end 10 in a plane which is generally perpendicular to the longitudinal centerline L of channel 4. At the opposite end of channel 4, side walls 6 terminate in a flange 12 defining the proximal, or heel end 14 of the garment aid 2. As with toe end 10, heel end 14 lies in a plane generally perpendicular to the centerline L of channel 4.

The outer surface 16 of side wall 6 is preferably smooth to permit the easy sliding of the compression garment onto and off of the garment aid 2. In one embodiment of the present invention, outer surface 16 has disposed thereon a slight texturing, such as a scrolling or knurling etched into surface 16. It is to be understood however, that even with the texturing of surface 16, it must still be sufficiently smooth to allow the easy placement and displacement of the compression garment. Interior surface 18 of side walls 6 is likewise smooth to allow the easy sliding of the garment aid 2 over the foot and up the leg as the garment is being placed onto the foot and leg. In the embodiment of the garment aid 2 illustrated in FIGS. 1 through 6, toe end 10 lies in a plane generally perpendicular to centerline L. In an alternative embodiment, the plane of toe end 10 may be disposed at a slight rake, such as about 10° from base 19 of channel 4 such that it is easier to begin sliding the compression garment over toe end 10 of the garment aid 2. It should also be appreciated that the juncture 24 of toe end 10 with the longitudinal edges 8 is rounded to permit the compression garment to easily transition over the juncture 24 as the garment is pulled onto or off of the garment aid 2. Opposite toe end 10 on channel 4, heel end 12 terminates in flange 14 and extends the entire perimeter of heel end 12 around channel 4 from one longitudinal edge 8 to the other.

U-shaped channel 4 may be made of any moldable or formable material which will not collapse when the compressive load of the stocking is imposed thereon. In a preferred embodiment, the channel is formed of ABS (acrylonitrile butadine styrene), a well known polymeric material that is comparatively inexpensive, durable and relatively easy to polymerize and mold. Alternatives include plastics such as high density polyethylene, polypropylene, polystyrene, poly vinyl chloride and nylon and metals such as stainless steel and aluminum. Since a compressive garment aid is frequently of limited utility to an individual, it is desirable that the device be of sufficiently low cost that it may be thrown away when the need for use of such as a hospital patient no longer requires the device. In the illustrated embodiment, ABS meets the low cost requirement and provides the necessary durability of the device over a use period of from a few weeks to several months. The requirement of compressive load is satisfied in the illustrated embodiment by the U-shaped aid 4 which is molded to approximately a one-quarter inch in thickness. Such formed U-shaped channels were able to withstand the loading of compressive, therapeutic stockings of compression grades 1, 2, and 3.

In the illustrated embodiment, U-shaped channel 4 measures approximately 11 inches in length, as measured along the bottom centerline U of the channel 4 from toe edge 8 to heel edge 14. The depth of channel 4, as measured in the plane of the heel edge 14 to the centerline U measured approximately 6 inches. At the heel edge, U-shaped channel 4 is about six inches wide and the curvature forming the U-shape of the cross section begins approximately at the diameter of the substantially circular bottom portion of the channel. In a preferred embodiment, the diameter of the bottom forming curve of the channel 4 remains essentially constant however the depth of the channel diminishes, causing the total cross section of the channel 4 to diminish noticeably approaching the toe edge. The size requirements of garment aid 2 are driven by the physical form over which the aid 2 must slide in the application of the compressive stocking on a leg. The present invention holds the compressive stocking sufficiently open with a U-shaped channel which will accommodate the foot at the instep and, as the aid carrying the compressive stocking is drawn over the heel, the U-shaped channel pivots on the heel to slide upwardly on the calf of the leg, but during the pivoting, the stretched stocking is held sufficiently above the instep that there is little resistance between the sliding stocking and the instep. By causing the profile of the garment aid to diminish in size toward the toe, the compressive stocking needs to be stretched less when initially being fitted on the aid 2 (FIG. 7). Once the stocking is first mounted on the toe end 10 of the aid 2, it is more manageably further expanded as it is moved progressively up the garment aid toward the heel end 14 (FIGS. 8 and 9). As noted earlier, the compressive loading of therapeutic stockings is substantial and as the material is gathered in any particular location, as along the longitudinal edge 6 of the aid 2, a reinforcement, or concentration of compressive force is experienced. This concentration adds to the difficulty of further advancement of the stocking on the aid toward the fully contained situation and also focuses the compressive forces tending to cause the U-shaped channel 4 to yield, if not collapse. Thus, by diminishing the cross section of the channel over a portion of the extent, the total compressive loading on the aid is lessened allowing a more lightweight construction of aid 2 and an easier pulling on of the compressive stocking.

In a preferred embodiment, the depth of channel 4 at the toe end 10, as measured from corner 24 to base 19, is about 2 and one-half inches. This depth is sufficient to allow the toe portion of a wearer's foot to be fully received within aid 2 such that the toe slightly exits toe end 10 (FIG. 10). The depth of channel 4 at the toe end 10 should allow the toe of a wearer to be received within Channel 4 at toe end 10 with only nominal contact with compression stocking S (FIG. 10)

As a matter of convenience, scallops 26 disposed along the longitudinal edges 8 extend to about one and one-half inches from the respective toe and heel ends 10 and 12. It is desirable that a mounting land 28 be disposed on the longitudinal edge 8 adjacent toe edge 10 to facilitate the initial application of the compression garment onto the garment aid 2. It should be appreciated that the substantial compressive forces developed within compression stocking when they are attempted to be stretched induces difficulty into the manipulation of the garment, whether it is being placed onto the aid or the body. By providing the mounting land 28, the initial portions of the top of the compression garment may be more easily stretched over the toe end 10 region of the aid as the compression stocking is initially being guided onto the aid 2 (FIG. 7). Thereafter, as the compression stocking is guided onto the aid, it is progressively pulled over scallops 26 to the opposite, or heel end 12 of the aid. Adjacent the heel edge, longitudinal edges 8 flare out into a heel land 30 which adjoin heel end 12 at heel end flange 14 at corners 32. Heel land 30 thus serves to reinforce the general heel portion of garment aid 2 as well as a marker for the extent to which the garment should be pulled onto the garment aid 2. Should the compression stocking be pulled past the heel end 12, it will tend to close the channel 4 and interfere with the application of the stocking onto the foot and the leg.

Scallops 26 dispose along longitudinal edge are preferably rounded at top and bottom, somewhat approximating a rounded saw tooth (e.g., sinusoidal) configuration. The depth of the scallops, measured a line tangent their tops to one tangent the nulls, is conveniently about one-half inch. In this preferred embodiment, scallops are spaced such that successive peaks or nulls are about one inch apart. This spacing and depth allows the compression stocking to be more easily accumulated onto the aid 2 (FIG. 9), such that it is fairly uniformly gathered over the extent of the scallops 26 disposed on longitudinal edges 8. Since this preferable spacing allows the slope of the "saw-tooth" to be less than about 45°, approximating about 30°, the compression stocking readily slides over the scallops as the garment aid is pulled over the foot onto the leg by the upward pulling of garment aid 2 along the leg.

In the preferred embodiment of the aid 2 illustrated, garment aid 2 is adapted with a handle device 34, illustrated as a cord, attached by attachment means 36, being a hole disposed in sidewalls 6, adjacent, however spaced from, comers 32. Alternatives such as straps and other pulling devices are suitable alternatives. Attaching devices may also include such as snaps, rivets, slips and the like in lieu of a hole. In its intended function, garment aid 2, after the compressive stocking, or the like, is disposed upon the aid, it is placed with the heel down, on the floor in close proximity to the foot and leg upon which the garment is to be placed. Cords 36 are to be positioned on either side of the leg (FIG. 10) and may be grasped by the intended wearer at approximately knee height. The wearer should then, with toe pointed, slip the toe into the garment aid 2 until the toe reaches the toe of the stocking adjacent the toe edge 10 of the garment aid 2 (protruding past the toe end 10 of aid 2). The wearer then gently, but firmly pulls upward on the cords such that the garment aid slips over the foot and instep, upwardly over the calf to past the knee, should the garment be of that length. As the wearer pulls upwardly on the cords causing the aid 2 to track along the calf, the stocking gradually slides over scallops, paying out in a manner similar to a line coming off of a reel, such that the stocking is placed uniformly on the wearer so as to provide the therapeutic benefit intended. The combination of shape, angulation and extent of the scalloped longitudinal edges 8 allows the compression garment S (stocking) to be readily placed in a uniform manner on the aid 2, such that the foot may be slipped readily into the aid to initiate the process of applying the stocking to the leg. As the scalloped longitudinal edges 8 control the pay out of the compression stocking as the aid is pulled upwardly on the leg, the resistance of the scalloped longitudinal edges 8 to the payout of the stocking causes the stocking to be disposed uniformly over the leg so as to provide effective compression.

As those skilled in the art should appreciate, the above described embodiments of the invention are illustrative only. Modifications may be made as are suggested without departing from the scope of the invention which is to be limited only by the appended claims.

I claim:

1. Apparatus for facilitating the donning of a compressive medical stocking comprising:

a) an elongated channel member having a curved base, upwardly extending side walls and opposite open ends defining a substantially U-shaped transverse cross section along its length;

b) the first of said open ends being the toe end and adapted to receive thereover a compressive medical stocking and the second of said ends being the heel end, the U-shaped cross section at said heel and being a much greater area than at said toe and;

c) said U-shaped channel member having a width and depth to substantially receive therein a foot of a wearer by whom said stocking will be donned;

d) said upwardly extending side walls each terminating in a longitudinally extending edge containing an irregular, generally serrated segment positioned along substantially the full length of each said edge intermediate the ends of said side walls;

e) said serrations of said segment being adapted with rounded peaks and valleys forming a slidable surface for receiving said compressive medical stocking thereover, f) said channel member being composed of a material having a thickness that gives said channel member a stiffness so that it substantially retains its U-shaped transverse cross section along its length when a compressive medical stocking is fully disposed thereon; and g) a handle device attached to said side walls adjacent said heel end and near the longitudinal edges, that is adopted to pull said elongated channel member over said foot and upwardly on the leg of said individual so that said compressive medical stocking is progressively pulled off of said side walls over said serrated segments, one segment at a time as the stocking pays out from the toe end and is thereby donned by said foot and leg.

2. The apparatus according to claim 1 wherein said channel member has a width and a depth at said toe end to substantially receive therein the toe of the foot of said wearer.

3. The apparatus according to claim 1 wherein said channel member has a width and depth at said heel end to substantially receive therein the heel, including the instep portion, of the foot of said wearer.

4. The apparatus according to claim 1 wherein the width of said channel member at said toe end is substantially equal or smaller than the width of said channel member at said heel end.

5. The apparatus according to claim 1 wherein the depth of said channel member at said toe end is substantially equal to or smaller than the width of said channel member at said heel end.

6. The apparatus according to claim 5 wherein the depth of said channel member at said toe end is one-half or less of the depth of said channel member at said heel end.

7. The apparatus according to claim 1 wherein the sloping edges of the teeth making up the serrated segment of said side wall edge lie at an angle to the line of said side wall edge of about 45° or less.

8. The apparatus according to claim 7 wherein said sloping edges of the teeth making up said serrated segment of said side wall edge lie at an angle to the line of said side wall of about 30° or less.

9. The apparatus according to claim 1 wherein said rounded peaks and valleys of said serrated edge emulate a scalloped edge.

10. The apparatus according to claim 1 wherein the side walls of said channel member at said heel end are flared outwardly from said channel member forming a flange.

11. The apparatus according to claim 1 wherein said serrated edge of said side wall edge is disposed between a substantially flat portion of said side wall edge at said toe end and said heel end.

12. The apparatus according to claim 1 wherein said serrated edge of said side wall edge is disposed between a substantially flat portion adjacent said heel end and said toe end.

13. The apparatus according to claim 11 wherein said flat portion of said side wall adjacent said toe edge is at least one inch in length.

14. The apparatus according to claim 12 wherein said flat portion of said side wall adjacent said heel edge is at least one inch in length.

15. The apparatus according to claim 1 wherein the radius of curvature of said U-shaped channel member underlying said upwardly extending side walls is substantially constant, with respect to any cross section, throughout the U-shaped curve of said channel member.

16. The apparatus according to claim 1 wherein the radius of curvature of said U-shaped channel member underlying said upwardly extending side walls is substantially greater at the base of said channel member throughout the U-shaped curved of said channel member, forming a flattened base in said channel member intermediate said upwardly extending side walls.

* * * * *